United States Patent [19]

Hildebrand et al.

[11] 4,343,060

[45] Aug. 10, 1982

[54] HYDRAULIC CONTROL SYSTEM FOR A STREET SWEEPER

[75] Inventors: Donald L. Hildebrand, Union; Ernest F. Prescott, Elgin, both of Ill.

[73] Assignee: Elgin Sweeper Company, Elgin, Ill.

[21] Appl. No.: 169,939

[22] Filed: Jul. 18, 1980

[51] Int. Cl.[3] ..... E01H 1/04

[52] U.S. Cl. ..... 15/84; 298/11; 298/22 C

[58] Field of Search ..... 15/82–87, 15/340

[56] References Cited

U.S. PATENT DOCUMENTS

| | | | |
|---|---|---|---|
| 2,833,116 | 5/1958 | Rush | 15/83 X |
| 3,802,022 | 4/1974 | Fleming | 15/84 |
| 3,833,961 | 9/1974 | Fortman et al. | 15/83 |
| 3,837,029 | 9/1974 | Kasper | 15/83 X |
| 4,138,756 | 2/1979 | Krier et al. | 15/83 |
| 4,171,551 | 10/1979 | Hildebrand et al. | 15/84 |
| 4,178,647 | 12/1979 | Wolynec et al. | 15/84 |

*Primary Examiner*—Edward L. Roberts

*Attorney, Agent, or Firm*—Hill, Van Santen, Steadman, Chiara & Simpson

[57] ABSTRACT

A street sweeper having a frame with a cab carried thereon. An engine is mounted on the frame for powering the sweeper. A series of operating mechanisms are supported on the frame for assisting in a sweepings pick-up operation. A series of hydraulic motors are provided with each being operatively associated with one of the mechanisms for operating the same. A single variable and reversible flow piston pump is operatively connected to the hydraulic motors and the hydraulic mechanisms for operating them at a constant speed. The engine operates the piston pump with a variable speed input. A control mechanism is mounted in the cab, and electrical circuit means is connected between the control mechanism and the piston pump and cooperable with said control mechanism enabling for selective operation of the mechanisms at selective rotational speeds for assisting in a sweepings pick-up operation.

10 Claims, 5 Drawing Figures

HYDRAULIC CONTROL SYSTEM FOR A STREET SWEEPER

BACKGROUND OF THE INVENTION

1. Field of the Invention

This invention relates to a new and improved street sweeper and more particularly to a new and improved hydraulically operated system for operating the various components of the street sweeper including such components as the side brooms, the conveyor, and the like.

2. Description of the Prior Art

Fixed displacement or variable displacement hydraulic pumps driving fixed displacement hydraulic motors to rotate main brooms, side brooms, and conveyors, have been commonly used on street sweepers for a number of years.

A flow divider has been commonly used to split the hydraulic flow from a single pump and direct the flow to two or more hydraulic motors for driving rotating sweeping components.

Variable displacement hydraulic pumps which are hydraulically pressure-flow compensated to provide a single constant output in gallonage within a given range of input speeds also have been known for a number of years.

Manually controlled variable displacement hydraulic pumps have been used to obtain a desired output in gallons per minute even though the input speed is constantly changing.

The H. M. Rush U.S. Pat. No. 2,833,116 discloses the use of a hydraulic drive providing a constant rotating speed of the sweeping elements while the power input source turns at a variable speed to propel the vehicle.

SUMMARY OF THE INVENTION

The present invention relates to a street sweeper having a new and improved hydraulic control system. The improved control system is uniquely constructed for operating selective sweeping mechanisms such as brooms, conveyors, and the like all at a constant speed while an engine for powering the street sweeper operates at variable speeds.

The present invention involves using a single variable and reversible flow piston pump as a variable pump for operating 3 or 4 fixed displacement hydraulic motors to rotate our sweeping mechanism (brooms and conveyor) at a constant speed, with a variable speed engine powering the hydraulic pump. Means are used for electronically sensing the rotational speed of the sweeping components, feeding the speed signal into an electronic computing and control unit which sends electric power to the electric displacement control valve on the variable pump. The pump swash plate is thus electrically and hydraulically positioned and repositioned as the engine speed changes so as to provide a constant (GPM) output from the pump so that the sweeping mechanism turns at a constant speed which was selected by the operator in the vehicle cab.

The same pump is used as a fixed displacement pump when the operator in the cab turns the electric control knob in the cab to the "accessory" position. This electric control sends electric power to the electric swash plate control in the variable pump. The pump swash plate tilts to a fixed predetermined position (established in the electric control box) and thus performs as a fixed displacement pump providing hydraulic oil for actuating hydraulic cylinders for elevation and returning the hopper, elevating or returning the main broom and conveyor, and retracting or extending the side broom or brooms. This is accomplished by checking the flow (check valve) to the hydraulic motors and free flowing through a check valve, oil to the main hydraulic cylinder control valve in the cab. Flowing the oil in a direction opposite to that when sweeping makes the check valve operation automatic. This is done in a hydraulic system in which the pump and actuating hydraulic components are in a "closed loop circuit". A "closed loop circuit" is a hydraulic system in which the working oil returns to the pump inlet after being used as opposed to returning to a hydraulic reservoir as is done in a "open loop circuit". Only the leakage and excess charge pump oil return to the reservoir. The low pressure side of the loop is charged with low pressure (180 PSI) at all times to meet the functional requirement of the piston pump.

The pump is activated by an operator controlled clutch so that the pump does not operate when not needed for sweeping or dumping. The system will function properly without a clutch with a small amount of power consumption when the sweeper is in the "Transport" mode.

The advantage of this system over conventional known systems is that a single variable displacement pump for both sweeping (hydraulic motors) and servo mechanism (hydraulic cylinders) operation is used. A conventional system would normally use a variable displacement pump for the sweeping function and a second fixed displacement pump for the hydraulic cylinder actuation.

According to other features of this invention, a street sweeper has now been provided with an electronic control system which is believed to be the first control system of its type to be used on street sweepers for maintaining the sweeping mechanism at a constant speed independent of the engine speed. Without this control, the sweeping rotational speed of brooms and the conveyor would increase and decrease with the engine speed.

As a result of providing the sweeper with the aforesaid feature, a cleaner sweeping operation can now be attained since the optimum broom speed can be maintained at as low engine speeds as 1000 R.P.M. This allows the operator to move the sweeping vehicle slowly through a conventional drive train system while maintaining the brooms and conveyor at a preferred more effective pick-up speed.

An important feature of our invention concerns our hydraulic system which comprises a bidirectional output variable volume pump in which flow in one direction is used to rotate hydraulic motors and the flow in the other direction is used to actuate reciprocating hydraulic cylinders to provide a single pump hydraulic system thereby avoiding multiple pumps and/or dual systems as presently used.

Yet another object of the invention is to provide a hydraulic system for a street sweeper which incorporates a variable volume hydraulic pump which is electronically controlled to provide a choice of three or more constant output speeds of the rotating sweeping components as the vehicle engine speed changes between 1000–3000 RPM to provide the optimum broom and conveyor speeds for a clean sweep regardless of engine speed.

A still further object of the invention is to provide a hydraulic system for a street sweeper which includes a single hydraulic cylinder to raise and lower the main broom, a set of two hydraulic cylinders (R.H. & L.H.) to raise and lower the conveyor while also actuating rear spring lockouts, all of which are actuated by a single hydraulic valve and control lever in the vehicle cab to provide simple operation from the cab.

Another feature of our invention concerns a street sweeper hydraulic system in which an electronically controlled variable volume pump is stroked to the "NEUTRAL" position during transport of the vehicle by turning a rotary electrical switch knob to an "OFF" position thus providing a more efficient system by terminating the working hydraulic flow when it is not needed.

Yet a still further feature of this invention concerns a street sweeper having a hydraulically elevated and lowered dirt hopper having a hydraulically opened and closed hopper door, which hopper can be operated by means of a single manually actuated hydraulic control valve.

Another feature of the hydraulic system concerns the use of means for orificing oil flow for sequential operation or to control hydraulic cylinder speed or control two hydraulic cylinder functions with one control valve.

A further feature concerns the provision of a hydraulic system that divides the oil flow to two or more motors that are sized to provide almost equal pressure in the subcircuits for improved pump efficiency, since the pump works at the highest pressure in any individual circuit.

BRIEF DESCRIPTION OF THE DRAWINGS

Other objects and features of this invention will more fully become apparent in view of the following detailed description taken in conjunction with the accompanying drawings, and in which a single embodiment is disclosed.

DESCRIPTION OF THE PREFERRED EMBODIMENTS

Figures 1, 3, 5:
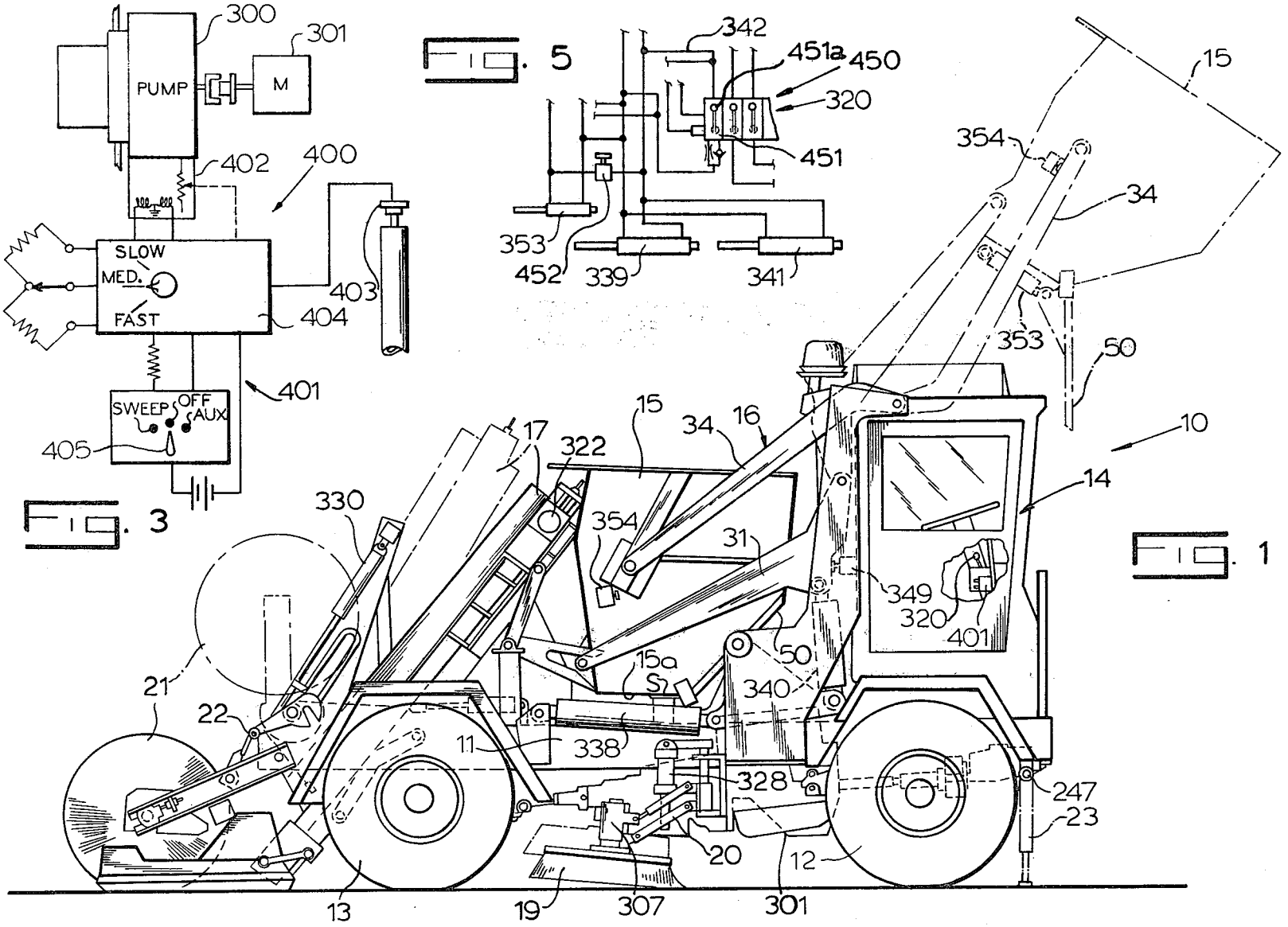
FIG. 1 is an enlarged side elevation of a street sweeper shown in full and dotted lines with various components illustrated in dotted lines to show alternative positions of the components during different phases of operation.
FIG. 3 is a fragmentary electrical schematic view illustrating the orientation of certain components.
FIG. 5 is a fragmentary hydraulic diagram illustrating a further modified system including a single four-way valve for elevating and dumping the hopper.

In FIG. 1 a self-propelled, four-wheeled street sweeper 10 is shown of the type that is particularly adapted to travel at relatively high speeds on open highways when traveling to and from areas to be swept and which is also capable of efficiently operating at slower speeds when sweeping streets.

The street sweeper 10 includes a main frame 11 that is supported by a front axle mounted on a pair of front wheels 12 and a rear axle mounted on a pair of rear wheels 13. An operator's cab 14 is disposed at the front end of the sweeper with a refuse collecting hopper 15 pivotally supported on the main frame 11 immediately behind the cab 14. As best seen in FIG. 1, when the hopper 15 is in a sweepings receiving orientation, a base plate **15*a* of the hopper is supported on pads S in a loading position relative to a conveyor 17. A power hopper elevating mechanism 16 is arranged to elevatably pivot the hopper 15 from the sweepings receiving position behind the cab 14 to a sweepings dump position (shown in broken lines in FIG. 1) over and forward of the cab 14**.

Supported on the main frame 11 at opposite sides are side brooms 19. In some modes of operation only one side broom may be employed. An elevating means 20 is provided for moving the side brooms 19 between transport and sweeping positions.

A main broom 21 is positioned at the rear of the sweeper 10 with a lifting means 22 arranged to swing the main broom 21 from a sweeping position to a raised travel position (shown in broken lines in FIG. 1). Detailed operations of the sweeper 10 are more fully described in assignee's U.S. Pat. No. 4,178,647.

An engine 301 provides the drive to power the wheels 12 and 13 for travel along a street surface of suitable speeds in accordance with traffic conditions and the sweepers' mode of operation.

The street sweeper engine 301 is also arranged to drive a reversible flow piston type pump 300 in which pressurized flow produced by the pump in one direction is arranged to power several hydraulic motors associated with the sweeping operation and the flow in the other direction is used to produce the hydraulic pressure flow for the control of the various hydraulic cylinders for positioning the hopper, the main broom, the side broom and the conveyor. The pump 300 comprises a variable volume swash plate type hydraulic pump which is subject to considerable rotary speed fluctuations during routine sweeping operations in accordance with the driving speeds of the engine 301 in propelling the street sweeper through traffic.

Since the output volume of the pump is directly related to the pump speed and swash plate angular adjustment, a constant pressurized hydraulic outflow needed to drive the broom motors and conveyor motor, for providing a good pick-up speed, is provided by an electric sensing and compensating control system. The control system continuously monitors the conveyor speed (which is directly proportional to broom speeds) and makes compensating adjustments to the pump swash plate as engine speed changes. When the pump speed begins to slow down, the pumping action (angle of the swash plate) is increased, conversely, when the pump speed increases, the swash plate angle is decreased to provide a generally uniform volumetric flow of oil to the hydraulic motors regardless of sweeper engine speeds.

The swash plate of the pump 300 is controlled by an electronic servo control system 400 as diagrammatically shown in FIG. 3 and includes an electronic computing and control unit 401; a controller 402 carried on the pump 300, and an electronic speed sensor 403.

Figure 2:
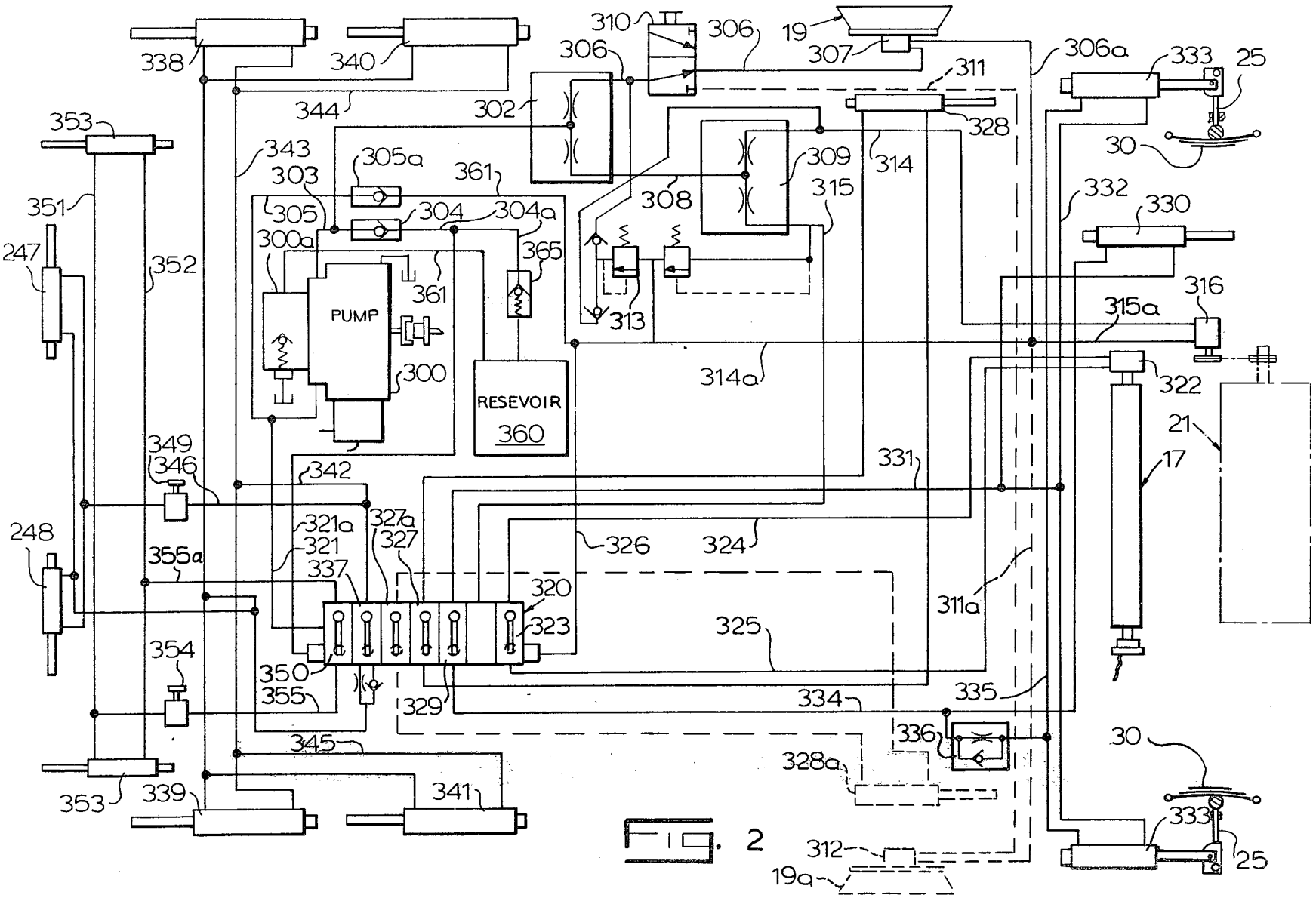
FIG. 2 is a hydraulic diagram illustrating the hydraulic features of our invention.

The sensor 403 electronically senses the rotational speed of one of the sweeping components such as the conveyor drive, and feeds a speed responsive signal back to the control unit 401. The control unit in turn sends an electric operating current to controller or swash plate stroker 402 in accordance with the setting of a control knob 404. The knob 404 adjusts a command potentiometer of the control unit 401 to set the desired speed of the sweeper element (conveyor). Also included in the control unit 401 is a control knob 405 which, along with the control knob 404 are conveniently located in the sweeper cab 14. The knob 405 controls a switch member (not detailed) which sets the direction of the output flow from the pump 300. Accordingly, during the sweeping operation, the knob 405 is set to the "sweep" position to direct a predetermined volume of pressurized oil to the sweeping elements by way of a line 303 as best seen in FIG. 2. The predetermined volume is selected by the control knob 404 and is maintained at the desired level by the electronic servo control system 400 as previously described.

A high degree of accuracy in pump output is achieved by measuring the speed of the conveyor with an electrical transducer, and using the signal as a feedback to a servo controller which is arranged to regulate the swash plate of the pump. A command potentiometer in the sweeper cab provides a broom speed adjustment by establishing a set point signal for setting the driving speed of the conveyor and accordingly, also the broom speeds.

The control knob 405 also has an "off" position in which the swash plate is stroked to a neutral position during the time the sweeper is moving to a work site, thus terminating the working hydraulic flow.

During a nonsweeping phase of operation, prior to or following the sweeping operation, the pump 300 is used as a fixed displacement pump, for positioning the various sweeping elements, the hopper and other moveable elements. Herein, the control knob 405 is set to the "auxiliary" position which adjusts the swash plate overcenter to a predetermined output setting which setting reverses the flow through the pump and directs pressurized fluid to a line 305. Herein, the line 303 becomes the intake line whereby the closed loop hydraulic system, as shown, returns substantially all of the fluid directly to the pump inlet after use.

Now referring to FIG. 2 of the drawings, it will be seen that the variable volume, reversible flow, hydraulic pump 300 is provided with a charging pump **300*a* connected thereto and also driven by the engine 301. The charging pump 300*a* is connected to the reservoir 360 by an intake line 361 and is arranged to supply a continuous supply of low pressure make-up fluid to the pump 300** to compensate for leakage with excess oil returned to the reservoir.

When the street sweeper 10 is arranged for street sweeping with the servo control system 400 adjusted as previously described, the reversible flow pump 300 delivers pressurized fluid to a flow divider 302 by way of the pressure line 303. A check valve 304 prevents the fluid from returning to the reservoir 360 by way of line **304*a*. The flow divider 302 is arranged to proportionally divide the hydraulic fluid produced by the pump 300 between a line 306, connected to a side broom fluid motor 307 for the right-hand side broom 19, and a line 308 connected to a second flow divider 309. Optionally, when a second broom 19 is desired for use on the left-hand side of the sweeper, a three-way valve 310 is provided in the line 306 to divert the divided hydraulic fluid flow from the right-hand side broom motor 307 to a line 311 which is connected to a left-hand side broom motor 312 (shown in broken lines). Thus, the proportioned pressure fluid from the flow divider 302 is utilized to rotatably drive either side broom as required by the setting of the valve 310. A relief valve 313 connected in the line 306, provides for overload protection of the fluid motor 307, and the fluid motor 312** when used.

Fluid pressure in the line 308 is again proportionally divided by the flow divider 309 between pressure lines 314 and 315 in accordance with fluid flow requirement. Herein, hydraulic fluid in the line 314 serves to power the main broom fluid motor 316 which is drivably connected to the main broom 21 at the rear of the sweeper. The relief valve 313 is also connected to the line 314 for the overload protector of the fluid motor 316. The proportional fluid flow in the line 315 is delivered to a control valve bank 320 for powering a reversible fluid motor 322 which serves to drive the sweeper's conveyor 17. A control valve 323 (for conveyor rotation) of the valve bank 320 is operably arranged to deliver pressurized hydraulic fluid to the motor 322 by way of a line 324 or optionally by way of a line 325. The valve 323 is a two-position valve with no "neutral" position. The valve activating lever is spring loaded for the "forward" direction of conveyor operation. It can be manually held in the "reverse" position but upon release, returns immediately to the "forward" position. Valve 323 could be an "open center" valve with a "neutral" position and the system would function satisfactorily. The reason that this type of valve was not used with out control was to eliminate the necessity of the sweeper operator having to activate an additional valve handle in order to begin the sweeping operation. Thus, the conveyor motor 322 may be driven in a reverse direction where required as, for example, in the event of a clogged or stalled conveyor chain or belt. Obviously, when the line 324 is pressurized to drive the conveyor chain or belt in a forward or loading direction, the line 325 serves as the return line connected back to the pump 300 in a closed loop through line 326 by means of internal porting in the valve 323. Further, when the motor is reversed and line 325 becomes the pressure drive line, the line 324 returns the hydraulic fluid to the pump 300 by way of the valve 323, line 326, a line 361, check valve **305*a* and the line 305 to the intake of the pump 300. Further return lines 306*a* and 311*a* for the side broom motors and return line 315*a* for the main broom motor are connected to the line 361 to direct oil back to the pump 300 in a closed loop flow by way of line 314*a***.

Thus, it will be appreciated that each of the fluid motors 307, 316 and 322 is supplied with a proportioned volume of pressurized fluid by the use of the flow divider 302 and 309 to drive the side broom 19, rear main broom 20 and the conveyor 17, all at related compatible speeds to provide an optimum sweeping action for the machine while utilizing a single variable volume hydraulic pump which is arranged to provide a constant volumetric outflow despite pump drive speed fluctuations due to engine speed variations.

When the sweeping operation is to be stopped and the machine is to be driven to dump site or to an overnight parking area, the side and main brooms 19 and 21 are retracted from contact with the street surface and the conveyor is stopped. Herein, the knob 405 of the servo control system 400 is turned to the "auxiliary" setting to reverse the angle of the pump swash plate and thereby reverse the pressure flow from the pump 300.

Thus, the entire pump output is directed to the line 305 with the check valve **305*a* now blocking pressure flow to the fluid motors 307 or 312 when used and to 316 and 322. The full output of the pump 300 is made available to the valve bank 320 by way of the line 305** and a line 321 connected thereto. Accordingly, a sufficiently high volume of pressurized hydraulic fluid is available to power the various hydraulic cylinders for rapid and responsive control of the various machine functions, which are not operated during the street sweeping operation of the machine.

The volume of oil pumped is, of course, set in accordance with the adjusted angle of the pump's swash plate, and since the machine is not travelling when hydraulic cylinders are actuated, the engine 301 may be run at a set speed to provide a fixed displacement pump to actuate the hydraulic cylinders.

A valve 327 or 327*a* in the valve bank 320 is actuated to direct pressurized fluid to cylinder 328 or 328*a* to raise the side broom 19 or 19*a* to a nonoperative, travelling position and a valve 329 is also actuated to charge a cylinder 330 to raise the rear main broom 21 for travel. The valve 329 is also effective to raise the conveyor 17 a suitable clearance distance off of the pavement along with its dust deflector frame 19*a*, as described in our U.S. Pat. No. 4,178,647.

It will be seen in the drawings that the valve 329 is connected to the cylinder 330 by a fluid line 331 with a branch line 332 connected to a pair of cylinders 333 which are operatively pressurized to raise the conveyor 17 and to lock out the rear axle springs 30 by lockout means 25 so that the vehicle frame 11 cannot drop down closer to the street due to rear spring action when sweeping. The lockout means is shown in greater detail in U.S. Pat. No. 4,171,551. A second fluid line 334 is connected to the cylinder 330 to provide a return flow passage for hydraulic fluid back to the pump intake by way of internal porting of the valve 329, a line 321*a*, and line 304*a*, through the check valve 304 and back to the pump through line 303.

A branch line 335 is also connected to the pair of cylinders 333 for returning hydraulic fluid to the pump intake. Thus, when retracting the main broom 21, along with the conveyor 17, fluid is directed to the cylinder 330 by way of pressure line 331 and to the conveyor lift cylinder 333 by way of the branch line 332. Hydraulic fluid expelled from the cylinder 330 returns to the pump intake by way of line 334, and fluid expelled from the cylinders 333 is returned to the pump by way of the branch line 335 to the line 334 and the valve 329. A flow restrictor 336 is interposed between the lines 335 and 334 to retard the movements of the conveyor lift cylinders 333. Herein, since the single valve 329 is used to control the movements of both the main broom 21 and the conveyor 17, and since the pressures required to lift the broom 21 are substantially greater than the pressures to lift the conveyor 17, the restrictor 336 thus serves to insure that proper sequential action occurs between the main broom and conveyor lift cylinders under the varying pressure demands of the elevating and retracting movements of the main broom 21 and the conveyor 17. Now, when the hopper 15 is to be emptied, a valve 337 is activated to pressurize lift cylinders 338, 339, 340 and 341 by way of fluid lines 342, 343, 344 and 345, to elevate the hopper 15 to the dump position shown in broken lines in FIG. 1. At the same time, a branch line 346, connected to the pressure line 342, directs pressurized hydraulic fluid to a pair of outrigger cylinders 247 and 248, with the actuation of the valve 337. The outrigger cylinders 247 and 248 are arranged to pivot a pair of front outrigger members in a ground supporting orientation to stabilize the front end of the sweeper 10, prior to lifting the hopper. At the start of the hopper dump cycle and with the hopper still resting on its lower supporting stop "S", a lower lift arm 31 contacts a two-way valve 349 connected in the fluid line 346, to hold it in an open, fluid passing position, against a biasing spring urging the valve to a closed or blocked position. Thus, when the valve 337 is first activated, the initial pressure flow is directed to the outrigger cylinders 247, 248 by way of line 342, branch line 346 and through the open two-way valve 349. This is in accordance with the pressure requirements of the system, since the minimal pressure required to extend the outrigger cylinders 247 and 248 to "set" the front outriggers 23, 23 is substantially less than the pressure required to elevate the hopper 15.

After the outrigger cylinders 247, 248 are fully extended and the pressure in this portion of the hydraulic circuit increases sufficiently, the lift cylinders extend to lift the hopper 15. Shortly after the hopper begins to raise, the lower lift arm 31 moves out of contact with the two-way valve 349, allowing it to close and lock the outriggers 23, 23 in their support position.

The outriggers 23, 23 are thus maintained in their support position throughout the rest of the hopper elevating and lowering cycles until again the lower lift arm 31 makes operative contact with the two-way valve when the hopper comes to rest on its stop pads "S". Only then with continued operation of the valve 337, will the outrigger cylinders be retracted and the front of the sweeper again be supported by the springs for the front wheels 12. As best seen in FIG. 1 of the drawings, the lower lift cylinders 338,339 initially produce the lifting movement in the hopper 15 because of the mechanical advantage provided by geometry of the elevating swing linkage 16 and which is further responsible for the tilting of the upper conveyor discharge end to its clearance position relative to the hopper to provide clearance for swinging movement therepast. After the lower lift cylinders 338,339 raise the elevating linkage 16 to a position in which the lifting forces become generally equal, each of the elevating cylinders are then employed to complete the hopper travel to its full dump position (seen in broken lines in FIG. 1). Lift cylinders 338,339,340 and 341 are of equal diameter. Hydraulic oil follows the path of least resistance. Cylinders 338-339 and 340-341 do not have to extend at the same rate as long as the total movement of 338-339 is equal to total movement of 340-341.

A valve member 350 of the valve bank 320 is operative to open the dump door 50 of the hopper 15, but only when the hopper has reached its full dump position. Herein, fluid lines 351,355 are connected between the valve 350 and a pair of hopper door cylinders 353 with a two-way valve 354, similar to the two-way valve 349, provided in the line 355 to block flow to the cylinders until the spring closed valve 354 is opened by contact with upper lift arm 34. This contact occurs when the hopper is raised to its full dump position, thereafter operation of the valve 350 will be effective to retract the cylinders 353 to drop the hopper door 50 as shown in broken lines in FIG. 1. After the waste material in the hopper has been dumped, the cylinders 353 are again extended to close the hopper door 50 by the operation of the valve 350 to direct pressurized fluid to the opposite side of cylinder 353 pistons by way of a line 355*a* and line 352 with the lines 351 and 355 returning fluid to the valve 350. After the dumping operation is completed the hopper 15 is lowered by the operation of the valve 337 to its FIG. 1 solid line position, ready again to receive sweepings. The valve opening contact between the upper lift arm 34 and the two-way valve 354 is broken with the first lowering arcuate movement of the hopper, whereby the dump door 50 cannot accidentally be opened. Return fluid flow from the cylinders is directed to the pump intake by way of internal porting of the valve 350 or 337, the lines 321*a* and 304*a*, check valve 304 and line 303. Fluid in excess of the intake volume required by the pump are by-passed to the reservoir 360 through a low pressure relief valve 365.

The valves 350, 337, 327, 327*a* and 329 of the valve bank 320 are open center type control valves with generally free flowing hydraulic fluid returned to the intake side of the pump at minimum back pressure when all of the control valves are in their neutral position. Operating pressure is developed in the system when one of the handles is moved to an operating position to direct fluid to a cylinder with the fluid expelled from the cylinder returned to the pump intake.

Figure 4:
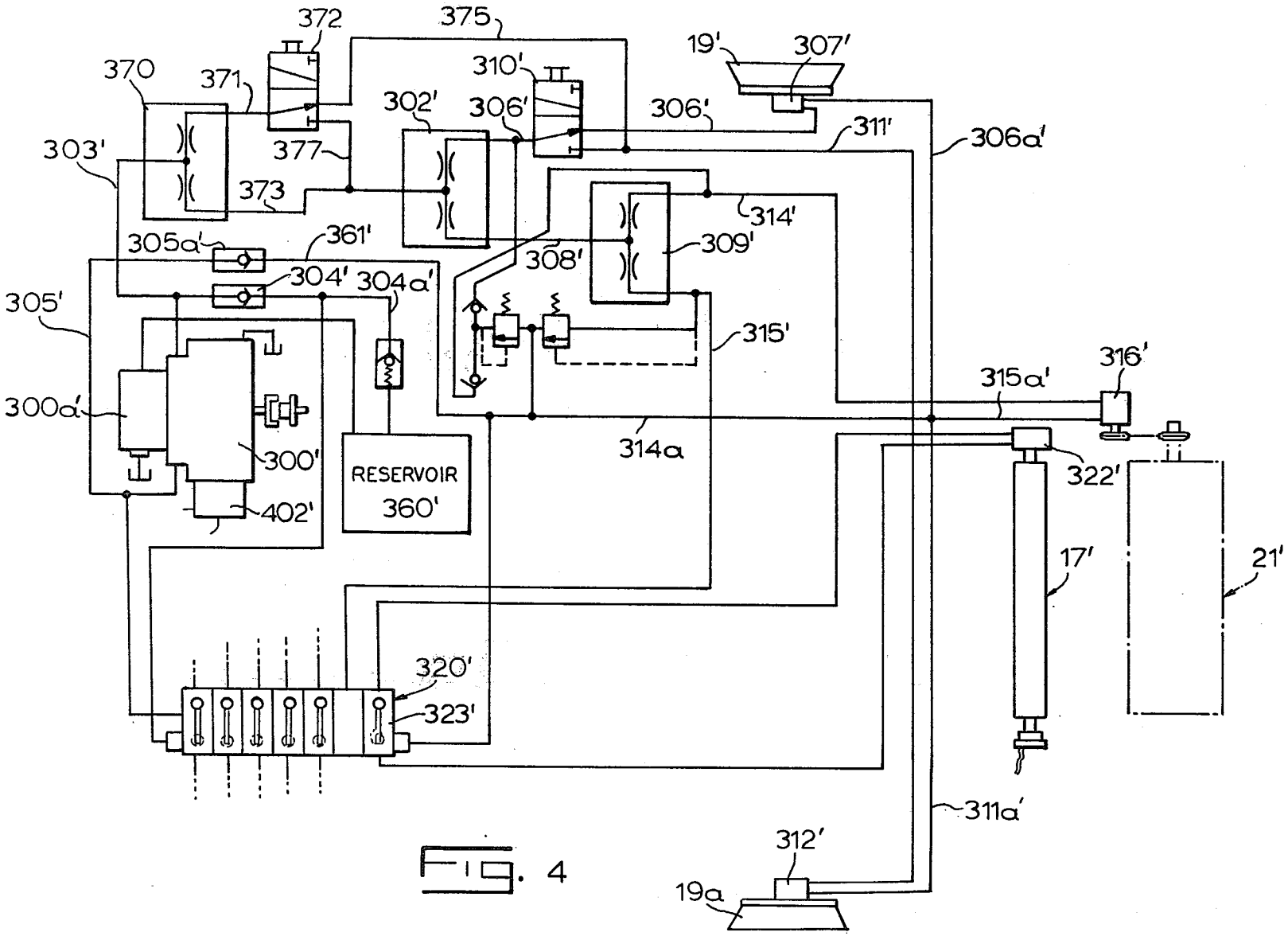
FIG. 4 is a fragmentary hydraulic diagram providing a modified system for the operation of the side brooms in accordance with several operational modes.

Now with particular reference to FIG. 4, a street sweeper 10 is provided with a pair of side brooms 19' and 19*a'* which brooms may be selectively operated in a fashion somewhat similar to the above description, but which also has the capability of operating both side brooms 19', 19*a'* simultaneously.

This system differs from the embodiment shown in FIG. 2 only in that portion of the circuit associated with the sweeping operation and accordingly, only that portion of the circuit is included in the FIG. 4 drawing. These portions of the circuit which are similar to the FIG. 2 circuit, are similarly numbered but with the addition of prime marks thereto. The reversible flow hydraulic pump 300' which supplies pressurized fluid for operating the hydraulic motors used in the sweeping operation, is a variable volume type pump with the same automatic electric control system as used with the FIG. 2 circuit. This electric control system senses slight variations in the speed of the conveyor and actuates the pump stroker 402' to maintain a generally constant speed. With the addition of a left hand broom 19*a'* for simultaneous operation with the right hand broom 19', the pump responds to a signal command as described above to provide sufficient oil for operating the four hydraulic motors 307', 312', 316' and 322' simultaneously.

In this mode of operation the pump 300' directs pressurized fluid to a flow divider 370 by way of a pressure line 303'. The check valve 304', connected to the line 303', prevents fluid from flowing to the reservoir 360.

Flow divider 370, proportionally divides the hydraulic fluid between a line 371, connected to a hand-operated three-way valve 372, and a line 373 connected to flow divider 302'. This flow divider 302' in turn proportionally divides the hydraulic fluid it receives from the flow divider 370 between a third flow divider 309' by way of pressure line 308' and a three-way valve 310' by way of pressure line 306'. The pressure line 306' extends beyond the three-way valve 310' for connection to the hydraulic motor 307' of the right hand broom 19'. The three-way valve 310' is also connected by a line 311' to the hydraulic motor 312' of the left hand broom 19*a'*. Thus, it will be seen that the valve 310' is employed to drivably control either the right hand broom 19' or the left hand broom 19*a'* in a manner somewhat similar in operation to the circuit embodied in FIG. 2. This valve, however, cannot provide simultaneous operation of both right and left hand brooms.

Thus, when both side brooms are to be placed in operation the three-way valve 310' is manually set to direct oil from the flow divider 302' to the right hand broom hydraulic motor 307' by way of pressure line 306' as shown in FIG. 4. Spent fluid returns to the intake side of the pump 300' by way of line 306*a'*, 314*a'*, 361', a check valve 305*a'* and line 305'. The three-way valve 372 is manually set to direct oil received from the flow divider 370 to the left hand broom hydraulic motor 312' by way of pressure lines 375 and 311' as shown in FIG. 4. The spent oil is returned to the intake side of the pump 300' by way of line 311*a'*, 314*a'*, 361', check valve 305*a'* and line 305'.

The flow dividers 370 and 302' are arranged to proportion the flows of hydraulic fluid going to each of the motors 307' and 312' so that both side brooms will rotate at the same speed for best sweeping efficiency as may be more fully understood from the following.

The flow divider 370 divides the hydraulic fluid produced by the pump 300' in a $\frac{1}{4}$ to $\frac{3}{4}$ proportion, with $\frac{1}{4}$ going to the valve 372 through line 371 and $\frac{3}{4}$ going to the line 373. The three-way valve 372 directs the full $\frac{1}{4}$ portion of pump output to the motor 312' of the left hand broom by way of lines 375 and 311' while the $\frac{3}{4}$ portion goes to the flow divider 302'. The flow divider 302' divides the pressurized fluid flow it receives between the three-way valve 310' and the flow divider 309', with $\frac{1}{3}$ going to the valve 310' and $\frac{2}{3}$ going to the flow divider 309'.

Thus, it will be appreciated that the valve 302' directs $\frac{1}{3}$ of the flow it receives (being $\frac{1}{4}$ of the volume produced by the pump 300') to the right hand motor 307' whereupon a generally uniform $\frac{1}{4}$ volume of the pump output is provided to drive each of the side broom motors. The flow divider 309' equally divides the $\frac{2}{3}$ flow ($\frac{1}{2}$ of the pump output) it receives from the flow divider 302' between pressure lines 314' and 315' to drive the motors 316' and 322' as generally described with the description of the FIG. 2 embodiment. Each of the four hydraulic motors will thus be driven with a speed associated with $\frac{1}{4}$ of the total pump output. Since the automatic electric control system 400 regulates the volume of oil delivered to the conveyor motor 322' at the preset volume, it will when all four motors are operated increase the total output gallonage to power the entire sweeping portion of the circuit at the desired preselected speeds. Further, when only one of the side brooms is to be operated the three-way valve 372 is adjusted to return the proportioned volume it receives from the flow divider 370 ($\frac{1}{4}$ of the pump output) back to line 373 by way of a line 377. Accordingly, the full pump output volume is delivered to the flow divider 302'. In this mode of operation the proportional flows ($\frac{1}{3}$ and $\frac{2}{3}$) of flow divider 302' provides $\frac{1}{3}$ of total pump volume to drive either side broom 19' or 19*a'* in accordance with the desired setting of the three-way valve 310' and the remaining $\frac{2}{3}$ pump volume is utilized to drive the conveyor 17' and rear broom 21'. Herein, the flow divider 309' equally divides the volume between the hydraulic motors 316' and 322'. Thus, each of the three hydraulic motors used will receive an equal proportioned volume ($\frac{1}{3}$) of the pump output. There again the pumps output volume is controlled by the automatic electric control system in which the pump stroker 402' adjusts the pump swash plate to produce a required volume for providing desired hydraulic motor speeds.

That portion of the circuit associated with the non-sweeping phase of operation, at a time when the pump is used as a fixed displacement pump, is fully shown and described in connection with the FIG. 2 embodiment and accordingly is not shown or described again in connection with the FIG. 4 embodiment.

Although certain proportions have been described in connection with division of hydraulic flows by the various flow dividers it should be understood that other proportions can be utilized where desired without departing from teachings of this invention.

The modified hydraulic circuit of FIG. 5 is indicated by the reference numeral 450. This circuit includes a number of components that are operably the same and described with reference to FIG. 5 with the same numerals as the circuit shown in FIG. 2.

The invention of FIG. 5 physically is brought about by using a single four-way valve 451 operated by a single valve lever or handle 451*a* for connecting the flow to the hopper lift cylinders 339, 341, and the hopper door cylinders 353 connecting that flow to all the cylinders in parallel. The blocking valve 452 in the circuit of FIG. 5 operates to prevent premature opening of the hopper door 50 or to prevent opening of the hopper door when the hopper 15 is in a position where it should not be dumped. With the valve 452 and the pressure relationship between the pressure required to open the hopper door and the pressure required to lift the hopper and retract the hopper, we found that for a normal dump operation we had natural sequencing of the hopper raising to the dump position and then the door opening in dumping the load and then with the four-way valve 451 the flow was reversed to retract the hopper to close the door and retract the hopper. The pressure required to close the door is very much lower than the pressure required to start retracting the hopper. Therefore, the door would close first all the way and then the pressure would increase to the point where it would retract the hopper back to its rest position and after the first few degrees of hopper movement from the dump position back toward the rest position, the blocking valve 452 would block off any possible flow to the hopper door cylinders 353 and therefore, as the hopper 15 returned to the rest position, regardless of the pressure relationship in the circuit, the hopper door 50 was restricted or prevented from opening because of the blocking valve 452. There are several advantages to the use of a single lever operation through the four-way valve 451. One advantage is that when the hopper is raised and moves into the dump position, the door 50 immediately starts to open so the operator is not confronted with a difficult operating situation especially if he were on a slope where he would be in a position where the vehicle might start to rock and then he would have to make a separate movement with his lever or handle 451*a*, as the hopper is raised into the dump position and on arrival of the hopper at its dump position, the door 50 would automatically start to open. The other main advantage is that with the single manually operable lever control valve 451 when the operator goes to lower the hopper 15, the circuit pressure causes the door to close first and the door is prevented from hitting the airconditioner or anything on the cab, because it would close. Thus, the single four-way manually actuated control valve sequentially controls the elevation of the hopper to a dumping position, the opening and closing of the hopper door, and the return of the hopper from its dumping position to its road travel position on the sweeper frame. With the two lever operation of FIG. 2 it is dependent upon the operator to remember to close that door 50 all the way first before he retracts the hopper 15, because if he does not do it, then the door can be in a position where the door may hit the cab or the air-conditioner that is carried on top of the cab.

The advantage of a double lever is that the operator has independent control of the hopper door so that if there was some operating reason he would desire, he could move the hopper all the way into the dump position and maintain the door closed in a situation where a truck were backing up, and was not yet in position to receive dumped material from the hopper which is really about the only advantage of the double lever hopper lift feature of FIG. 2.

Thus, it takes less pressure to close the hopper door (FIG. 5) because the mechanical advantage in the developed linkage is not very great at that point and also when the hopper is being retracted for work on the rod side of the cylinders as opposed to the headside of the pistons, which means we have less force available to retract the hopper with the same pressure, so it takes a little greater pressure because we are working on the rod side of the cylinderheads and also because the mechanical advantage is poor at that point between the hopper, cylinder, the centerline of forces and the mechanical advantage of the linkage.

Thus, it may be seen that a single reversible flow hydraulic pump and a minimum number of operating valves are required to fully control all of the operations of the machine in a single and responsive fluid pressure system.

We claim as our invention:

1. A street sweeper having a frame with an engine mounted on said frame for powering the street sweeper for movement along a sweeping surface, a series of operating mechanisms mounted on said frame to assist in a street sweeping pick-up operation and a plurality of hydraulic motors arranged to power said operating mechanisms and a series of hydraulic components arranged to move said operating mechanisms into a street sweeping pick-up position and into a retracted position wherein the improvement comprises:

a variable volume and reversible hydraulic pump which is suitably driven by said engine and operatively associated with said plurality of hydraulic motors when said pump is regulated to produce fluid pressure flow in a first direction and which is operatively associated with said series of hydraulic components when said pump is regulated to produce fluid pressure flow in a second direction;

means to selectively regulate said pump as a variable volume pump for producing fluid pressure flow in said first direction at a consistent preset output irrespective of the driving speed of said engine and to selectively regulate said pump as a fixed volume pump for producing reversed fluid pressure flow in said second direction, and a hydraulic system including a first closed loop circuit for interconnecting said variable volume reversible pump with said plurality of hydraulic motors and back to said pump for directing operating hydraulic pressure flow in said first direction and a second closed loop circuit for interconnecting said variable volume reversible pump with said series of hydraulic components and back to said pump for directing operating hydraulic pressure flow in said second direction.

2. The street sweeper of claim 1 further characterized by said variable volume pump including electronic controlled means operable for stroking the pump to a "NEUTRAL" position during transport of the vehicle, the electronically controlled means further including a rotary electrical switch knob turnable to an "OFF" position thus enabling more efficient operation through the termination of the working hydraulic flow when it is unneeded.

3. The street sweeper of claim 1 further characterized by the hydraulic system including means for dividing the oil flow to at least two of said motors that are sized to provide almost equal pressure in the fluid circuits for improved pump efficiency thereby enabling the pump to work at its highest pressure in any individual circuit.

4. A street sweeper, a frame and a cab carried thereon, an engine on the frame for powering the sweeper, a series of operating mechanisms on the frame for assisting in a sweepings pick-up operation, a series of hydraulic motors each operatively associated with one of said mechanisms for operating the same, a single variable and reversible flow piston pump for operating said hydraulic motors and said hydraulic mechanisms at a constant speed, said engine operating said piston pump with a variable speed input, a control mechanism in said cab, and electrical circuit means between said control mechanism and said piston pump for operating said mechanisms at selective rotational speeds for assisting in a sweepings pick-up operation.

5. The street sweeper of claim 4 further characterized by said pump including electronically controlled means operable for stroking the pump to a "NEUTRAL" position during transport of the sweeper, the electronically controlled means further including a rotary electrical switch knob turnable to an "OFF" position thus enabling more efficient operation through the termination of the working hydraulic flow when it is unneeded.

6. A street sweeper, a frame, and engine on the frame for powering the sweeper, a series of rotating mechanisms on the frame for assisting in a sweepings pick-up operation, a series of hydraulic motors each operatively associated with one of said mechanisms for operating the same, a single variable volume and reversible flow piston pump for operating said hydraulic motors and said hydraulic mechanisms at a constant speed, said engine operating said piston pump with a variable speed input, a control mechanism and electrical circuit means between said control mechanism and said piston pump for operating said mechanisms at selective rotational speeds for assisting in a sweepings pick-up operation which rotational speeds are independent of engine speed.

7. The street sweeper of claim 6 further characterized by the variable volume and reversible flow piston pump being operable to cause flow in one direction to be used to rotate the hydraulic motors and being operable in a reverse direction to cause the flow to be used to actuate the hydraulic mechanisms to provide a single pump hydraulic system.

8. The street sweeper of claim 6 further characterized by the electric circuit means being controllable to provide a choice of at least three constant output speeds for rotating the rotating mechanisms as the engine speed changes between 1000–3000 rpm to provide the optimum speeds for the rotating mechanisms for a clean sweep regardless of engine speed, the rotating mechanisms including main and side brooms.

9. A street sweeper having a frame, a cab positioned at the forward end of the frame, broom means on the frame, a hopper for receiving sweepings positioned on the frame behind the cab, means on the frame behind the cab for loading sweepings from the broom means to the hopper, lift mechanism for the hopper, lift cylinder means connected to the lift mechanism for moving the hopper through an arc over the cab to a dumping position for unloading sweepings into a truck at a forward end of the sweeper, a dump door on said hopper and a hydraulic door cylinder for opening and closing the dump door, a hydraulic circuit connecting said lift cylinder means and said hydraulic door cylinder, and only a single manually actuated hydraulic control valve operatively connected to said hydraulic circuit for sequentially operating the lift cylinder means to cause the lift mechanism to lift the hopper over the cab and for then actuating the door cylinder to open the door to cause the contents of the hopper to be unloaded, the single manually actuated hydraulic control valve being reversibly operable to first cause the door cylinder to close the dump door and to maintain the door closed while actuating the lift mechanism to return the hopper over the cab to a position for receiving sweepings.

10. A street sweeper having a frame, broom means on the frame, a hopper for receiving sweepings positioned on the frame, means on the frame for loading sweepings from the broom means to the hopper, lift mechanism for the hopper, lift cylinder means connected to the lift mechanism for moving the hopper to a dumping position for unloading sweepings into a truck at a forward end of the sweeper, a dump door on said hopper and a hydraulic door cylinder for opening and closing the dump door, a hydraulic circuit connecting said lift cylinder means and said hydraulic door cylinder, and only a single manually actuated hydraulic control valve operatively connected to said hydraulic circuit for sequentially operating the lift cylinder means to cause the lift mechanism to lift and move the hopper to a dumping position and for then actuating the door cylinder to open the door to cause the contents of the hopper to be unloaded, the single manually actuated hydraulic control valve being reversibly operable to first cause the door cylinder to close the dump door and to maintain the door closed while actuating the lift mechanism to return the hopper to a position on the frame for receiving sweepings.

* * * * *